US005402986A

United States Patent [19]

Wiltse

[11] Patent Number: 5,402,986

[45] Date of Patent: Apr. 4, 1995

[54] POSITIVE DRIVE WINCH

[76] Inventor: Lee B. Wiltse, 3720 W. Higgins Lake Dr., Roscommon, Mich. 48653

[21] Appl. No.: 59,773

[22] Filed: May 10, 1993

[51] Int. Cl.[6] ..... B66D 3/16

[52] U.S. Cl. ..... 254/358; 254/366; 254/375

[58] Field of Search ..... 254/358, 365, 366, 375, 254/378, 294, 311

[56] References Cited

U.S. PATENT DOCUMENTS

| | | | |
|---|---|---|---|
| 2,282,634 | 5/1942 | Young | 254/358 X |
| 2,356,371 | 8/1944 | Anderson | 254/311 X |
| 2,690,240 | 9/1954 | Schroeder | 254/358 X |
| 2,703,162 | 3/1955 | Keim et al. | 254/358 X |
| 3,081,067 | 3/1963 | Hickson | 254/378 X |
| 3,326,398 | 6/1967 | Reed . | |
| 3,369,795 | 2/1968 | Fujita | 254/358 X |
| 3,894,720 | 7/1975 | Koji | 254/358 X |
| 4,046,235 | 9/1977 | Shutt | 254/356 X |
| 4,438,904 | 3/1984 | White | 254/311 |

*Primary Examiner*—Daniel P. Stodola
*Assistant Examiner*—Michael R. Mansen
*Attorney, Agent, or Firm*—Robert L. McKellar

[57] ABSTRACT

A winch for retrieving and releasing rope or cable that is attached to a boat hoist or the like in order to lift or lower a boat located on the hoist. The release of the boat hoist to lower the boat into the water or the like is thus carried out safely and under controlled conditions.

1 Claim, 3 Drawing Sheets

POSITIVE DRIVE WINCH

The invention disclosed herein deals with a device for retrieving and releasing rope or cable that is attached to a boat hoist or the like in order to lift or lower a boat located on the hoist.

More specifically, this invention deals with a winch which is a positive drive winch which will allow the retrieval, or slow release of rope or cable under highly controllable conditions and which permits an operator to raise a boat or lower it under control of a brake using only one operation to accomplish both of the tasks.

Thus, it is one object of this invention to provide a device which has a single operation to lower and raise a hoist on which a boat may rest.

It is another object of this invention to provide a compact and small size device.

It is a further object of this invention to provide a positive drive winch which allows for lifting weights which are heavier than is possible with conventional boat hoist winches.

It is still another object of this invention to provide the lowering of a hoist and boat under highly controlled conditions so that the boat may be lowered with safety.

BACKGROUND OF THE INVENTION

Boat hoists are a conventional means of storing boats during the boating season and there are many hoists that one can use for this purpose. Such boat hoists are constructed such that there is a stationary stand which supports a rack which rack is movable in the stationary stand. The movable rack is provided with guides so that it will stay essentially centered in the stationary stand and there is a series of pulleys, and cables that are attached to the movable rack and which accommodates the raising and lowering of the movable rack. The cable is thus attached on one location of the stationary stand, moved through various pulleys, and the opposite end is attached to the hub of a cable winch which facilitates the storage of the cable as it is wound unto the hub when the movable rack is raised. When the movable rack is lowered, the cable unwinds from the hub, moves through the pulleys and allows the movable rack to be lowered. Each of the various boat hoists not only have their own design, but they traditionally have their own type of winch.

Some types of winches include those that are direct gear drives, chain drives, combinations of chain drives and gears, and the like.

These winches have several problems, one of which is that the gear drives use less space, but are hard to operate, do not lift heavy loads, and use only a pawl and rachet type of braking system.

On the other hand, those winches that use chain drives, or combinations of chain drives and gears tend to be very big in size and heavy, and they also generally are limited on the amount of load that they can lift.

In addition, electrical winches for this purpose have been used utilizing the electric power from batteries as a source of energy, or from conventional electricity sources, but those systems often fail when the electric components become wet.

One device of the prior art is disclosed in U.S. Pat. No. 3,326,398, issued Jun. 20, 1967 to Reed. This device deals with a boat loader for trailers wherein the boat can be moved up onto a trailer or removed from the trailer by the movement of an automobile that is attached to the trailer. The device uses a drum to collect cable and features a clutch mechanism for allowing the drum to freely rotate and release the cable when it is desired to move the boat from the trailer back into the water. However, this clutch is of the type that it is either completely off, or completely on and thus the boat movement off of the trailer is not easily controllable.

The device of the instant invention overcomes the problems stated above for the prior art devices.

THE INVENTION

The invention herein deals with a positive drive winch which comprises a housing which has a top, a bottom, a front, a back, a left side and a right side. Each side has located in the center of its upper half, an upper shaft opening which openings are opposed to each other and are in horizontal alignment with each other. Each side has located in the center of its lower half, a lower shaft opening wherein the lower shaft openings are opposed to each other and are in horizontal alignment with each other. The lower shaft openings are surmounted by a bearing hub and each bearing hub is secured to the housing and contains a bearing in it.

An upper stationary shaft has a pawl end and a fixed end and the shaft is located such that it passes through and is supported by the upper shaft openings wherein the pawl end extends outwardly from the housing and terminates in a gravity pawl rotatable around the upper shaft.

A lower rotatable shaft has a threaded end, and a non-threaded end, and is supported by and rotatable in the bearings in the lower shaft openings. The threaded end extends beyond the bearing hub.

The upper shaft passes through the center bore of a small hub, which is rotatable on the upper shaft and has a small sprocket on its right end and a large flange on its left end, the large flange having gear teeth along its outer perimeter.

The lower shaft passes through bore of a large tube which has a large flange on each of its left end and its right end which large tube is rotatable on the lower shaft, the flange on the right end has gear teeth along its outer perimeter.

The lower shaft has located thereon and rigidly affixed thereto, a lower shaft small sprocket, which lower shaft small sprocket is located adjacent to the left flange of the large hub and on the inside of the left wall. The lower shaft has rigidly affixed to its left end, adjacent the bearing hub, a large external flange, the large external flange having adjacent thereto a brake pad which may be freely rotatable on the lower shaft and said brake pad has adjacent thereto a star toothed wheel which contacts the gravity pawl and prevents the toothed wheel from rotating in one direction. The small sprocket on the lower shaft is connected to the flange on the left end of the small hub on the upper shaft by a first drive chain and, the flange on the right end of the large tube on the lower shaft is connected to the small sprocket on the right end of the small hub by a second drive chain.

DETAILED DESCRIPTION OF THE INVENTION

Figure 1:
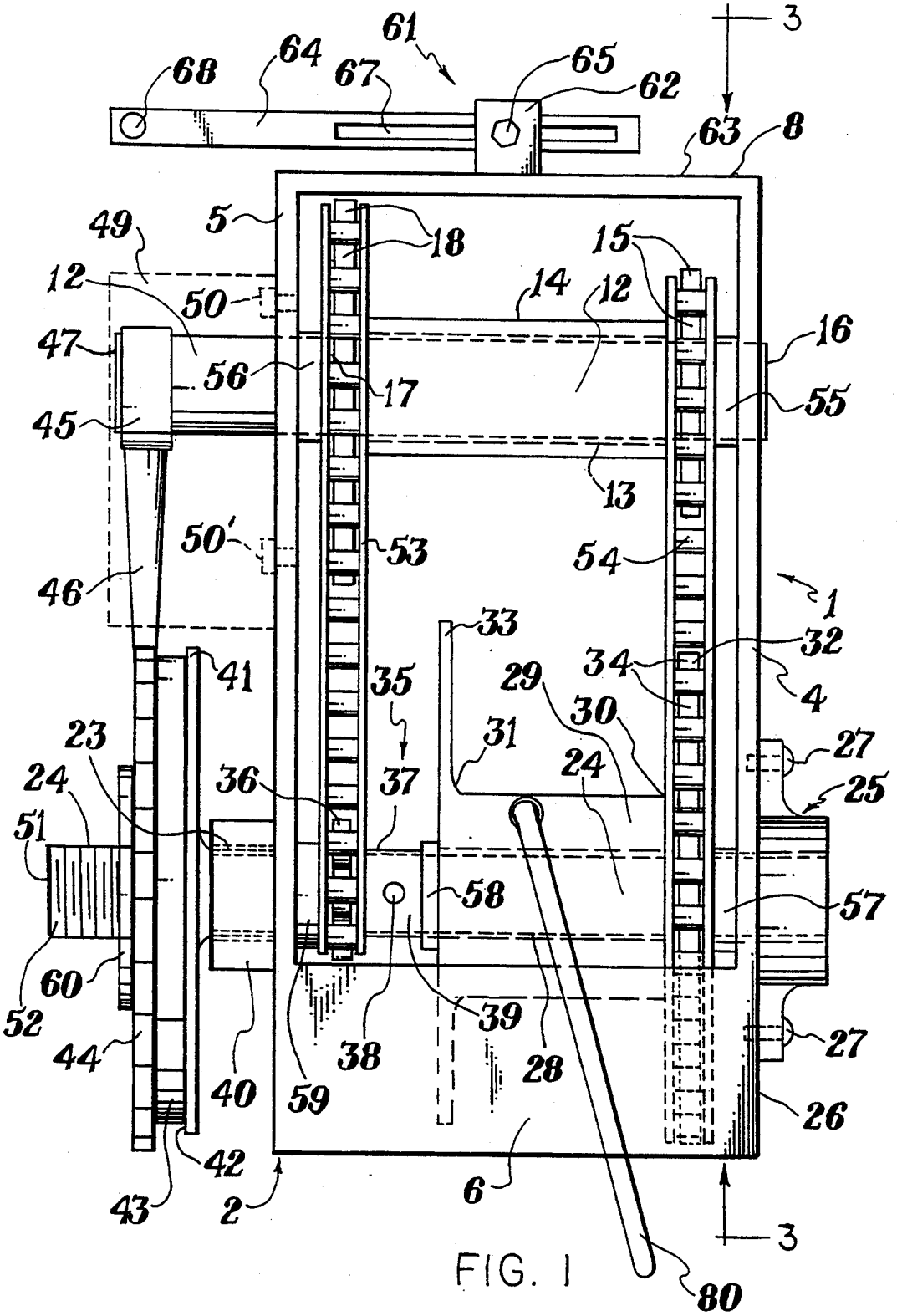
FIG. 1 is a full front view of a winch of this invention with the face plate removed to show some of the internal mechanism with the device in a full braking mode.

With reference to FIG. 1, there is shown a winch 1 of this invention. Although there is no strict limitation on overall size of the winch, the most practical size is one in which the smaller is the better. The winch of this invention is nominally 8"×10"×14" in overall outside dimensions.

The winch 1 is constructed such that the internal mechanism and the external mechanism is supported by a housing 2, which housing 2 has a back 3 (FIG. 3), a right side 4, a left side 5, a front 6, a top 8, and a bottom 9. In this specification, the references to "left" side, "front", "back", "right" side, "top", and "bottom" are for purposes of orienting the device for illustration and should not be taken as limiting the claims. Thus, the "front" 6 is the orientation of the device towards the viewer of FIG. 1 wherein the brake module, external to the housing 2 (discussed infra), is located to the viewers left and the "right" side is to the viewers right, while the top 8 can be identified by the surmounted locking mechanism discussed infra. It should be noted by those skilled in the art that this winch can be constructed in a left-handed configuration as well.

The view from the front in FIG. 1 is shown with the front plate 7 (FIG. 4) removed.

With regard to FIG. 1 there is shown a front view of one of the winches 1 of the instant invention with the front plate 7 removed to show the interior of the device. Moving to FIG. 2, there is shown the left side 5 of the winch 1, in which there is an upper shaft opening 10 essentially in the center of the upper half of the left side 5. For purposes of this invention, this upper shaft opening 10 has an opposite counterpart 11 in the opposite side wall, i.e. in the right side 4 (FIG. 3), located essentially in the upper half of the right side 5' wall, and these openings are horizontally aligned with each other. These upper shaft openings 10 and 11, support a non-rotatable, but not rigidly affixed, i.e. upper stationary shaft 12, which extends between the left side 5 and the right side 4, walls, such shaft 12 being viewed more clearly in FIG. 1, wherein it is shown external to the housing 2, and in phantom, internal to the housing 2.

Figure 3:
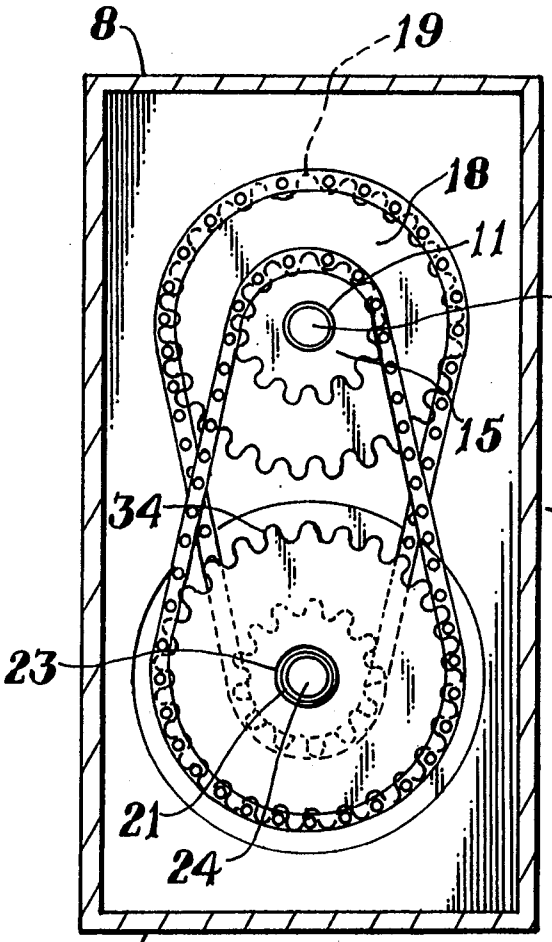
FIG. 3 is a cross-sectional view of the right side of the winch of FIG. 1, through the line A—A of FIG. 1, wherein part of the internal mechanism is shown.

The upper stationary shaft 12 passes through the center bore 13 of a tube 14 (FIG. 1 in phantom and FIG. 3). This tube 14 is rotatable on the upper stationary shaft 12 and the tube 14 has a small sprocket 15 rigidly mounted on its right end 16, the small sprocket 15 being commensurately rotatable with the tube 14. The tube 14 has on mounted near its left end 17, a large flange 18, which large flange 18 has sprocket teeth 19 on its outside perimeter.

The lower walls of the left side 5 and the right side each have a lower shaft opening, 20 and 21, respectively, which are located in the center of the lower half of the sides, which openings 20 and 21 are oppositely opposed and horizontally aligned. These openings are each filled with bearings 22 and 23, respectively, and these bearings 22 and 23 support a lower rotatable shaft 24 which extends between the right side 4 and through the left side 5, walls, such shaft 24 being viewed clearly in FIG. 1, wherein it is also shown that the left end 51 of the shaft is threaded with machine threads 52. The bearing 22 is fitted into a housing 25 which is mounted to the external surface 26 of the right side 4, with bolts or screws 27, while the bearing 23 is located in the hub 40 rigidly mounted on the surface of the left side 5 of the housing 2, although a mounting of the bearing 23 could be accomplished essentially the same as the mounting of the bearing 22 on the right side 4.

The lower shaft 24 passes through the center bore 28 of a large drum 29 and the drum 29 is freely rotatable around the lower shaft 24. This part of the invention is critical as will be set forth below in detail. The large drum 29 has a large flange 32 and 33 respectively, on each of its right end 30, and on its left end 31, which flanges 32 and 33 are rigidly affixed to the large drum 29, and are rotatable commensurately therewith. The large flange 32 (shown partially in phantom in FIG. 1) has sprocket teeth 34 around the totality of its outside perimeter, while the large flange 33 does not contain such sprocket teeth.

In addition, the lower shaft 24 has detachedly mounted near its midpoint 35, a lower shaft small sprocket 36. The lower shaft small sprocket 36 is mounted on the lower shaft 24 such that the shaft 24 runs through the center bore 37 of the sprocket 36 and the lower shaft small sprocket 36 is located inside the left side 5 of the housing 2. However, the small sprocket 36 is not intended to rotate about the shaft 24 and therefore, there is a stabilizing pin 38, which runs through openings in the hub 39 of the sprocket 36, and which passes through an opening in the lower shaft 24 to lock the small sprocket 36 to the lower shaft 24 and which causes the small sprocket 36 to rotate commensurately with the lower shaft 24 when the lower shaft 24 is rotated.

The lower shaft 24 extends beyond the left side 5 and through a rigidly mounted hub 40 which houses the bearing 23. There is rigidly affixed to the lower shaft 24, external to the hub 40, a large flange 41, and the lower shaft 24 is centered in the large flange 41 such that the flat surface 42 of the large flange 41 is presented away from the housing 2.

Adjacent to the flat surface 42, and interfacing therewith, is a brake pad 43, which is a freely rotatable disk around the lower shaft 24, such that when the brake of the system is not operational, the brake pad 43 is freely rotatable around the lower shaft 24, but when the brake is operational, the brake pad 43 is mated with the flat surface 42 and creates a braking effect to the entire system as the flat surface 42 is rigidly connected to the housing 2. Located immediately adjacent to the brake pad 43 is a star wheel 44, which is freely rotatable around the lower shaft 24 when the brake is not operational. When the brake is operational, the star wheel 44 is intimately mated with the brake pad 43 to help create the braking effect. In addition, in the operational mode, the star wheel 44 accepts the tine portion 46 of a gravity pawl 45 to assist in a brake and hold effort.

Figure 2:
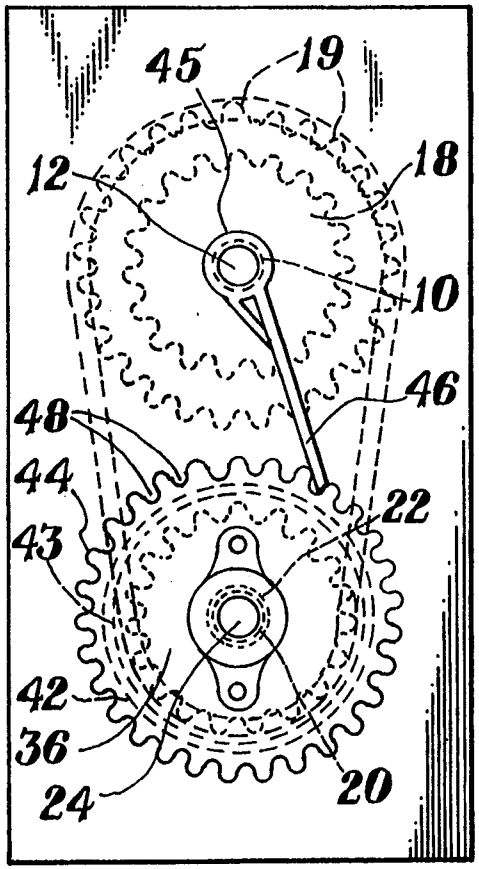
FIG. 2 is a view of the left side of the winch of FIG. 1, showing part of the external brake mechanism and part of the internal mechanism in phantom.

The gravity pawl 45 is shown in FIGS. 1 and 2 and is located on the left end 47 of the upper stationary shaft 12. The gravity pawl 45 is freely rotatable around the upper stationary shaft 12 and as can be observed, the gravity pawl tine 46 rides freely on the star wheel 44 and its only function is to drop by the weight of gravity into the hollows 48 (FIG. 2) of the star portion of the star wheel 44, and prevent the backward motion of the star wheel 44, when the brake system is operational. With regard to FIG. 1, there is shown in phantom, a cover box 49 for the upper shaft 12, and the gravity pawl 45. This cover box 49 helps retain the upper shaft 12 in place, by impinging on the left end 47 of the upper shaft 12. It is contemplated within the scope of this invention to utilize other means of retaining the upper shaft 12 in position, such as by the use of a key 90 (FIG. 4) and the like. The cover box 49 can be retained in place by bolts or screws 50 and 50'. The cover box 49 and the bolts 50 and 50' are shown in phantom in FIG. 1.

The small sprocket 36 on the lower shaft 24 is connected to the large flange 18 of the upper shaft 12, by a first drive chain 53, while the small sprocket 15, on the right end 16 of the upper shaft 12 is connected to the large flange 32 on the lower shaft 24, by a second drive chain 54.

It should be noted that the there is used a variety of metal bushings throughout the device of this invention in order to conform to the required alignment of the various sprockets and flanges, and the like. Thus, there are bushings located on the upper shaft 12 on both ends of the hub which are shown in FIG. 1 as 55 and 56. On the lower shaft 24, bushings are 57, 58, and 59. In addition, there is a thrust bearing 60, such as an oil impregnated thrust bearing, located adjacent the outside surface of the star wheel 44.

Figure 4:
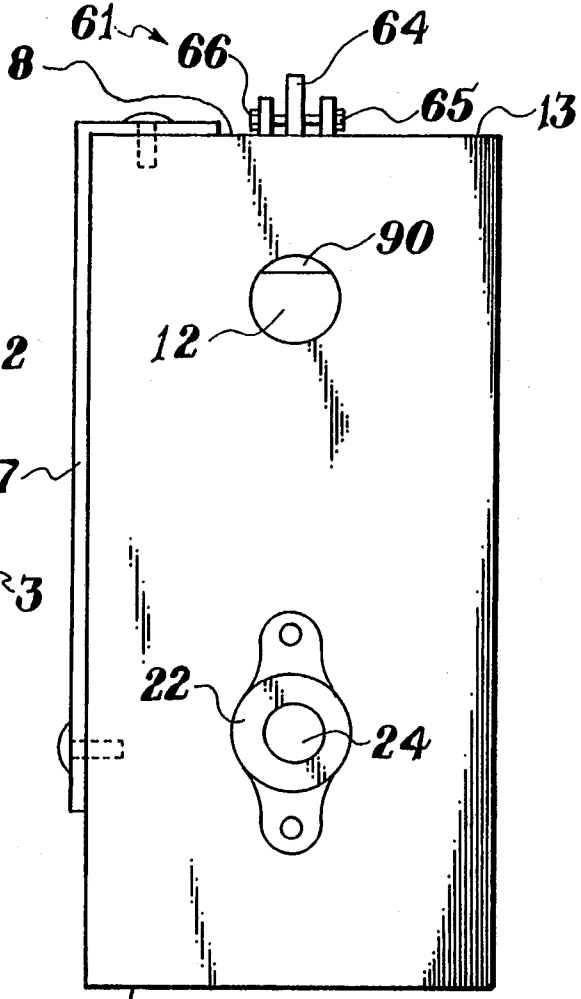
FIG. 4 is a full view of the right side 4 of the winch 1.

In some models, it may be desirable to have a locking mechanism for the device so that it cannot be tampered with and for such a purpose, one such locking mechanism 61 is shown in FIG. 1, and with reference to the same in both FIGS. 1 and 4, there is shown a yoke 62, which is rigidly attached to the top surface 63 of the top 8 of the housing 2, for example, by welding. The yoke 62 has openings (not shown) through each arm of the yoke 62 to accommodate a bolt 65, which is fastened on one end by a nut 66. Slidably mounted in the yoke 62 is a locking bar 64 which has a long, narrow slot-like opening 67 through it. The locking bar 64 is mounted in the yoke 62 such that the bolt 65 runs through the slot-like opening 67 and allows the locking bar 64 to slide by means of the slot-like opening 67, on the bolt 65 for the full length of the slot-like opening 67.

In addition, the locking bar 64 has an opening 68 in the end distal to the slot-like opening 67, the purpose of which will be detailed infra.

Figure 5:
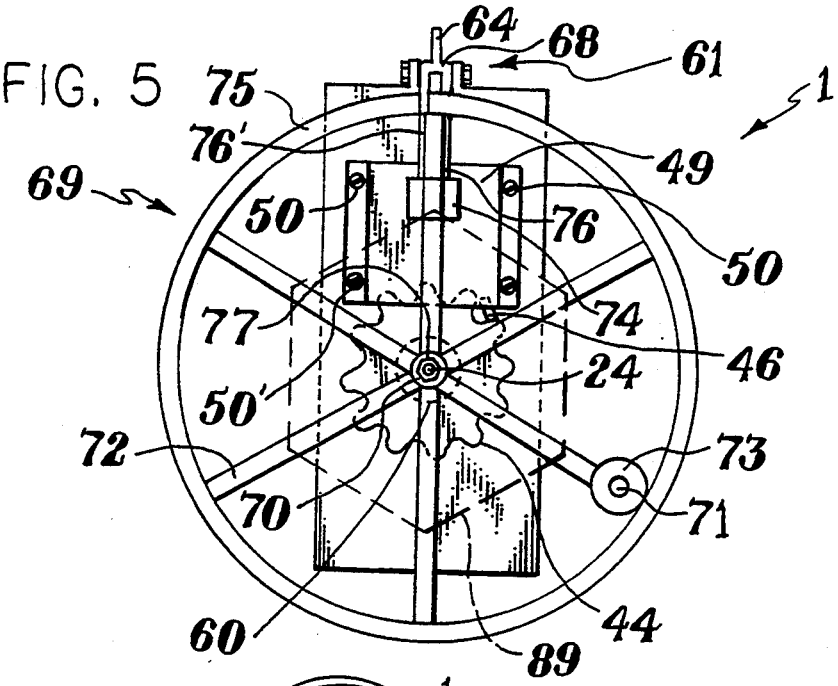
FIG. 5 is a full view of a winch of this invention with a hoist wheel in place to drive the device. This figure is not on the same scale as the other figures, in that, this Figure is on a smaller scale in order to accurately describe the relationship of the hoist wheel and the winch device.

With reference to FIG. 5, there is shown the entire winch in a scale reduced from the other figures in order to show all of the elements of the device and its interrelationship with the hoist wheel 69.

Shown is the winch 1, the cover box 49, the star wheel 44, the locking mechanism 61, a hoist wheel 69, and a locking nut 70. Also shown are bolts 50 and 50', lower shaft 24, plastic bushing 60, and the tine 46 of gravity pawl 45. Not shown in this Figure is the internal threading of the hub of the hoist wheel 69, which allows the hoist wheel 69 to rotate on the threads 52 of the lower shaft 24. When the hoist wheel 69 is rotated in a clockwise direction, the hoist wheel 69 travels on the threads 52 of the lower shaft 24 until the hub 77 contacts the plastic bushing 60, which compresses the plastic bushing 60.

The hoist wheel 69 is equipped with a handle 71 which is attached to the hoist wheel 69 such that it stands vertical to a plane formed by the spokes 72 (vertical to the plane of the drawing paper) of the hoist wheel 69. Shown is a back plate 73 for stabilizing the handle 71 on the hoist wheel 69. Also shown in phantom is a stabilizer plate 89 for the hoist wheel 69.

With reference to the locking mechanism, there is shown a padlock 74 which can be fitted through the opening 68 of the locking bar 64, with the outer rim 75 of the hoist wheel 69 between the tines 76 and 76' of the padlock 74. When the padlock 74 is closed and locked, the hoist wheel 69 is prevented from rotating and thus, the device is locked securely. When it is desired to use the device, the padlock 74 is removed, the locking bar 64 is slid away from the hoist wheel 69, out of the way of the rotation of the hoist wheel 69, and the hoist wheel 69 is free to rotate.

It is contemplated within the scope of this invention to utilize other devices to rotate the lower shaft 24 for operation of the device and the large wheel configuration shown herein is not necessary for the ultimate operation of the inventive device and is only shown as one means by which the device can be operated.

In operation, one can utilize the handle 71 of the hoist wheel 69 to turn the hoist wheel 69 in a clockwise rotation. As noted above, the hub 77 of the hoist wheel 69 is threaded interiorly to match the threads 52 of the lower shaft 24 and when the hoist wheel 69 is turned clockwise, the hoist wheel 69 is carried on the threads 52 to meet with and compress the thrust bearing 60, which in turn compresses against the star wheel 44, which in turn compresses the brake pad 43 against the brake wheel 42 and applies pressure thereto.

Figure 6:
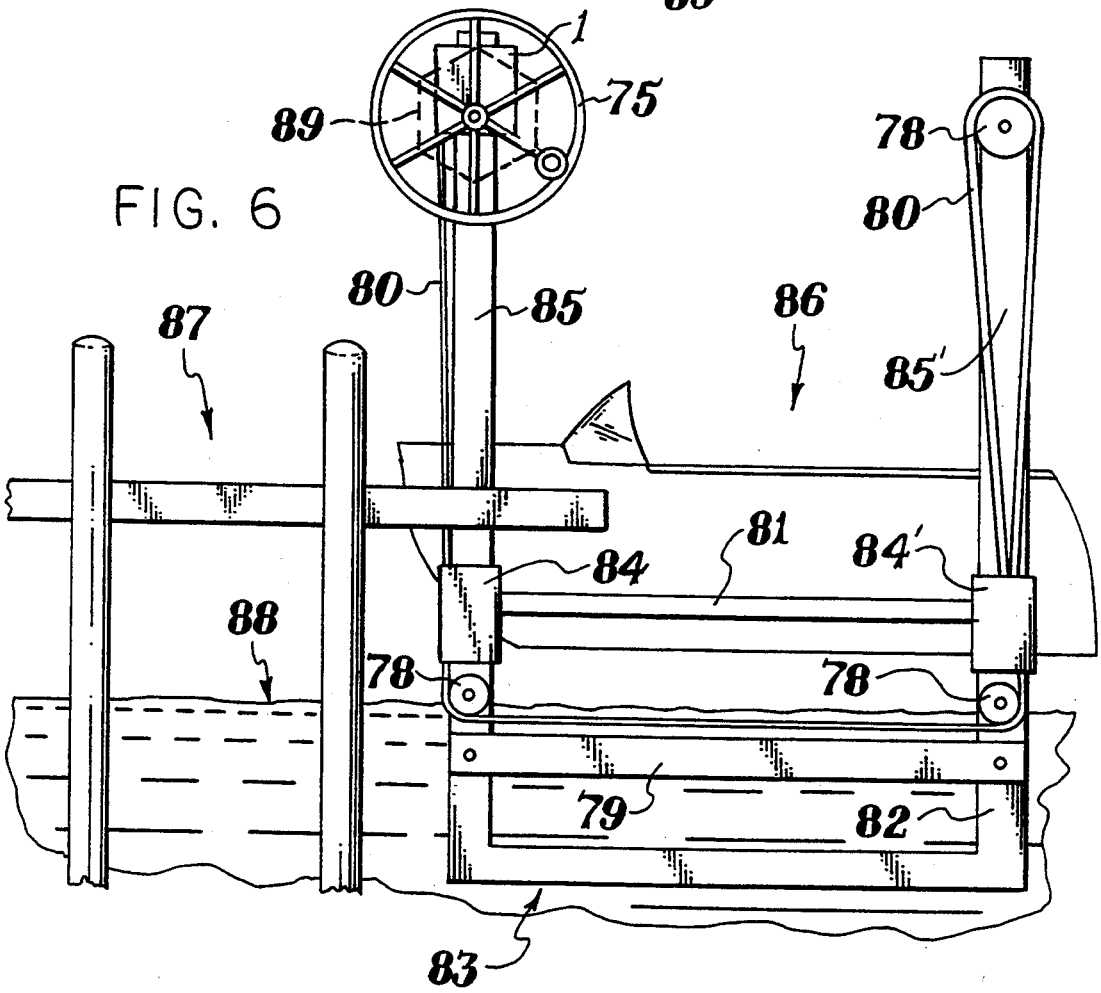
FIG. 6 is a side view of a boat in a boat hoist along side of a dock in the water, showing a device of this invention.

When the pressure is applied to the brake wheel 42, the lower shaft 24 is caused to turn in a clockwise rotation. The shaft 24 is directly connected to the small sprocket 36 and the clockwise rotation of the lower shaft 24 causes the small sprocket 36 to rotate in a clockwise rotation, which causes the first drive chain 53 to drive the large circular flange 18 on the upper shaft 12, in a clockwise rotation. The rotation of the large flange 18, and hence the tube 14, causes the small sprocket 15 to assume a clockwise rotation, which drives the second drive chain 54 in a clockwise rotation, which in turn drives the large sprocket 32 in a clockwise rotation, which causes the cable 80 connected to the drum 29 to move over the pulleys 78 (FIG. 6) and be collected by the drum 29 which in turn causes the hoist rack 81 (shown in FIG. 6) to be lifted within the stationary stand 82 of the boat hoist 83. The hoist rack 81 is configured such that it has guides 84 and 84' which slide up and down on the legs 85 and 85' of the stationary stand 82, and 79 designates a stabilizer bar for the boat hoist. When the rack 81 has been lifted to the desired level, the operator just simply stops the clockwise rotation of the hoist wheel 69 whereupon the device is in an operational brake mode. With the brake system set, and with the gravity pawl tine 46 resting in place in the hollows of the star wheel 44, the hoist is enabled to hold the rack 81 and the boat 86 in place.

It should be noted that when the hoist wheel 69 is being rotated in a clockwise rotation, the drum 29 is not directly rotated by the lower shaft 24, but is instead rotated by the chains 53 and 54, and relevant sprockets, as described supra.

This fact becomes very important and critical to this invention when it is desired to move the rack 81 down and put the boat 86 back into position on the water, or if desired on dry land, or the like.

In reversing the mechanism of this winch 1, the hoist wheel 69 is rotated in a counterclockwise rotation. This activity releases the braking action of the brake pad 43 and the brake wheel 42 and allows the drum 29 to reverse in a counterclockwise rotation and allows the cable 80 to be removed from the drum 29. However, the critical aspect of the invention is that when this activity is undertaken, there is absolute control of the movement of the drum 29 and its speed can be controlled such that the rack 81 can be lowered safely. The more that the hoist wheel 69 is rotated counterclockwise, the more the brake is released and the faster the cable 80 will be pulled from the drum 29 to lower the rack 81 and the boat 86. It should be further noted, that once a speed is achieved that the operator believes is sufficient to achieve the lowering of the rack 81 and the boat 86 in a safe manner, the hoist wheel 69 is no longer rotated in the reverse direction on the threads 52, and the novel feature of the drum 29 freely rotating around the lower shaft 24 at the desired speed to lower the rack 81 and the boat 86, without loosening the hoist wheel 69, and hence the brake system, is novel. This novel feature is accomplished by the drum 29 driving the second drive chain 54 in a counterclockwise rotation, which causes the first drive chain 53 to rotate in a counterclockwise rotation, which drives the lower shaft 24 independently of the rotating drum 29 and allows the hoist wheel 69 to rotate in a counterclockwise rotation without causing the hoist wheel 69 to move away from the braking system along the threads 52 and lose any pre-determined braking effect. Also, if desired, the lowering rack 81 and boat 86 can be stopped at any point during the lowering and raising by again turning the hoist wheel 69 in a clockwise rotation to re-apply the braking system and stop the rotation of the drum 29.

It should be understood that the hoist 83, the boat 86, the dock 87, and the water line 88 are not considered to be part of this invention but are illustrated in order to show the invention in its fullest aspects.

Thus it can be observed that the devices of this invention are new and novel.

That which is claimed is:

1. A positive drive winch, said winch comprising a housing, said housing having a top, a bottom, a front, a back, a left side having an upper half and a lower half, and an inside and outside, and a right side having an upper half and a lower half;

each said side having located in the center of its upper half, an upper shaft opening which upper shaft openings are opposed to each other and in horizontal alignment with each other;

each said side having located in the center of its lower half, a lower shaft opening, wherein the lower shaft openings are opposed to each other and in horizontal alignment with each other, said lower shaft openings being surmounted by a bearing hub, each said bearing hub being secured to the housing and containing a bearing therein;

a gravity pawl;

an upper stationary shaft having a pawl end and a fixed end and located such that it passes through and is supported by the upper shaft openings wherein the pawl end extends outwardly from the housing and is affixed with the gravity pawl freely rotatable around the end of the upper stationary shaft;

a lower rotatable shaft having a threaded end, and a non-threaded end, said lower rotatable shaft being supported by and rotatable in the bearings in the lower shaft openings, said threaded end extending beyond the bearing hub;

a tube, having a right end and a left end and having a hollow center bore, said tube being rotatable on the upper stationary shaft;

the upper stationary shaft passing through the center bore of said tube, which tube has a small sprocket on its right end, and a large circular flange on its left end having gear teeth along its outer perimeter;

a large drum having a hollow center bore, a right end and a left end and a large circular flange on each of its left end and its right end, said large drum being rotatable on the lower rotatable shaft;

the lower rotatable shaft passing through the center of said large drum;

the lower rotatable shaft having located thereon and rigidly affixed thereto, a lower shaft small sprocket, which lower shaft small sprocket is located adjacent to the left flange of the large drum and on the inside of the left side of the housing;

the lower rotatable shaft having rigidly affixed to its left end, adjacent the bearing hub, a large external flange, the large external flange having adjacent thereto a brake pad which may be freely rotatable on the lower shaft and said brake pad having adjacent thereto a star-toothed wheel which contacts the gravity pawl and which gravity pawl prevents the star-toothed wheel from rotating in one direction thereby;

said small sprocket on the lower shaft being connected to the flange on the left end of the small hub on the upper shaft by a first drive chain and, the flange on the right end of the large tube on the lower shaft being connected to the small sprocket on the right end of the small hub by a second drive chain.

* * * * *